US005211228A

United States Patent [19]

Watkins

[11] Patent Number: 5,211,228

[45] Date of Patent: May 18, 1993

[54] DIVERTER SYSTEM

[75] Inventor: Bruce J. Watkins, Houston, Tex.

[73] Assignee: Dril-Quip, Inc., Houston, Tex.

[21] Appl. No.: 867,324

[22] Filed: Apr. 13, 1992

[51] Int. Cl.[5] ..... E21B 21/06; E21B 7/12

[52] U.S. Cl. ..... 166/88; 166/85; 166/358; 166/379; 175/5

[58] Field of Search ..... 166/88, 84, 85, 358, 166/379; 175/214, 209, 5, 7, 9

[56] References Cited

U.S. PATENT DOCUMENTS

| | | | |
|---|---|---|---|
| 2,546,638 | 3/1951 | Humason | 166/88 |
| 3,295,600 | 1/1967 | Brown et al. | 166/88 X |
| 3,478,822 | 11/1969 | Holbert, Jr. et al. | 166/88 |
| 3,602,303 | 8/1971 | Blenkarn | 166/88 X |
| 4,071,085 | 1/1978 | Grable et al. | 166/84 |
| 4,326,584 | 4/1982 | Watkins | 166/84 |
| 4,646,844 | 3/1987 | Roche et al. | 166/379 |
| 4,971,148 | 1/1990 | Roche et al. | 166/88 |

OTHER PUBLICATIONS

Brochure of Hughes Offshore Drilling on *KFDJ Diverter System.*

*Primary Examiner*—Hoang C. Dang

*Attorney, Agent, or Firm*—Vaden, Eickenroht, Thompson, Boulware & Feather

[57] ABSTRACT

There is disclosed a system for use in drilling subsea wells from platforms wherein drilling fluids may be diverted at either of two levels beneath the rotary table of the platform.

2 Claims, 4 Drawing Sheets

Figure 1A:
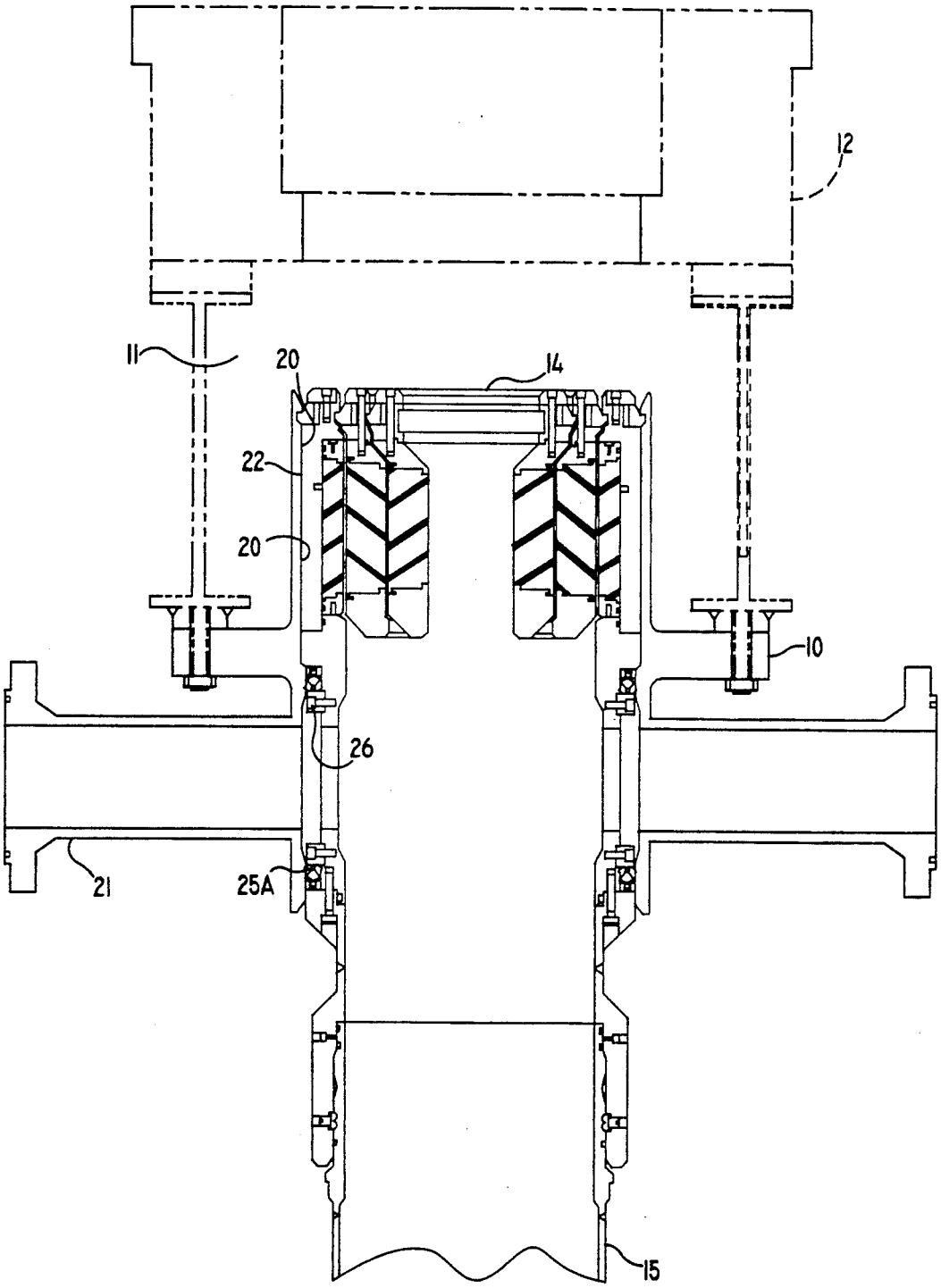

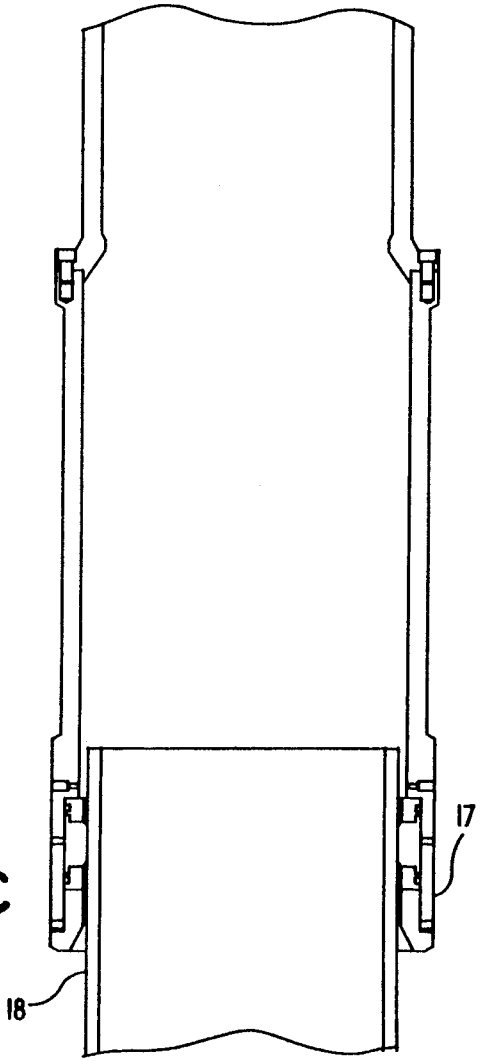
FIG. IC
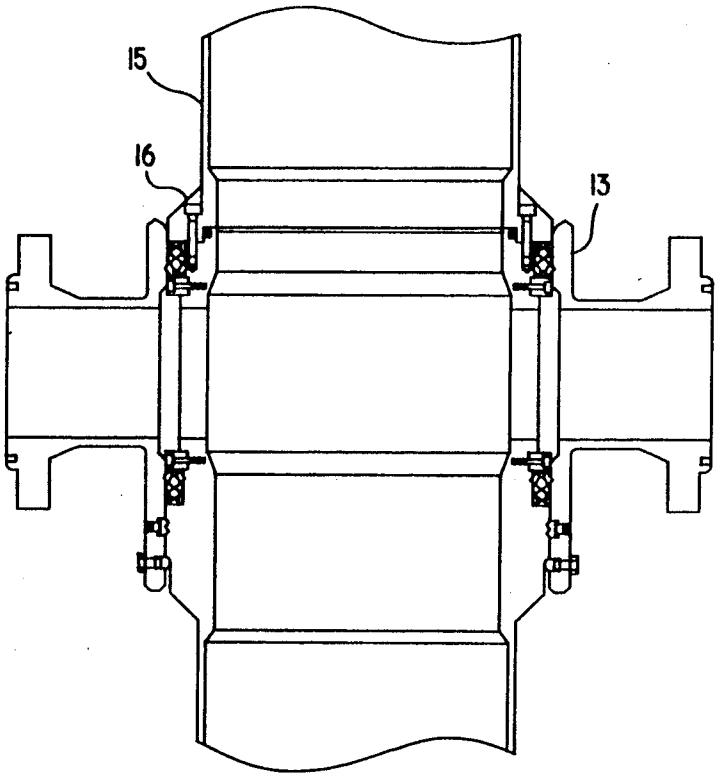
FIG. IB

DIVERTER SYSTEM

This invention relates generally to subsea wells, and, more particularly, to improved diverter systems for use in drilling such wells from platforms above a subsea wellhead.

The purpose of such systems is to provide low pressure control over the well during the preliminary stages of drilling, and, for this purpose, the system includes a housing supported with its bore beneath the rotary table on the platform, and having one or more side outlets from the bore for connection with drilling mud return lines on the platform. A diverter assembly comprising a tubular body adapted to be lowered into a supported position in the bore has one or more ports aligned with each side outlet from the bore, and a spool suspended from the tubular body has an overshot packer at its low end which is lowered over the upper end of a conductor extending upwardly from the wellhead as the body is landed in the bore of the housing. More particularly, the tubular body carries means which seals between it and the housing bore to confine flow within the body into the side outlets, and packers are adapted to be lowered into and landed in the diverter body to seal about a drill string extending downwardly from the rotary table and through the spool leading to the conductor, whereby drilling fluid returns about the string are "diverted" into flowlines connected to the outlets for return to reservoirs from which the drilling fluid may be recirculated into the drill string.

The area beneath the platform and thus in and around the diverter housing is quite crowded with piping and other obstructions which often interfere with the flowlines. Hence, the operator might desire to divert the returning drilling fluid at a significantly lower level, perhaps 25–50 feet below the rotary table. This could be accomplished by providing the spool with fittings to which flowlines could be connected after the diverter body has been landed in the housing. However, this would be time consuming and expensive to perform, and, in order for the fittings to pass through the bore of the diverter housing, the spool diameter would have to be reduced, which in turn would reduce the size as the drill bit on the lower end of the drill string which is lowered through the spool.

The object of this invention is to provide a diverter system which is of such construction that the operator may, at his option, divert drilling fluid at a lower level without having to reduce the diameter of the spool and thus the size of the drill bit lowered through it.

These and other objects are accomplished, in accordance with the preferred and illustrated embodiment of the invention, by a diverter system which includes another or secondary housing having a bore therethrough and one or more side outlets from the bore and adapted to be supported beneath the primary housing with its bore aligned with the bore of the primary housing, when so supported, and in which the spool suspended from the diverter assembly body includes a tubular member intermediate its ends for fitting closely and landing within the bore of the secondary housing and having one or more ports therethrough, each adapted to be aligned with a side outlet in the secondary housing, when so landed, and means thereon for sealing with the bore ,of the secondary housing to confine flow within the member into the side outlets. More particularly, the bore of the secondary housing is essentially as large as that of the primary housing so that a full sized drill bit may pass therethrough.

In the drawings, wherein like reference characters are used throughout to designate like parts:

FIGS. 1A, 1B and 1C are a vertical sectional view of a diverter system constructed in accordance with a preferred embodiment of the invention, with the diverter assembly installed within the upper primary housing in FIGS. 1A, the tubular member of the spool located within the bore of the secondary housing in FIG. 1B, and a packer at the lower end of the spool sealably engaged about the upper end of a conductor in FIG. 1C, the spool being interrupted along its length both above and below the tubular member.

Figure 2:
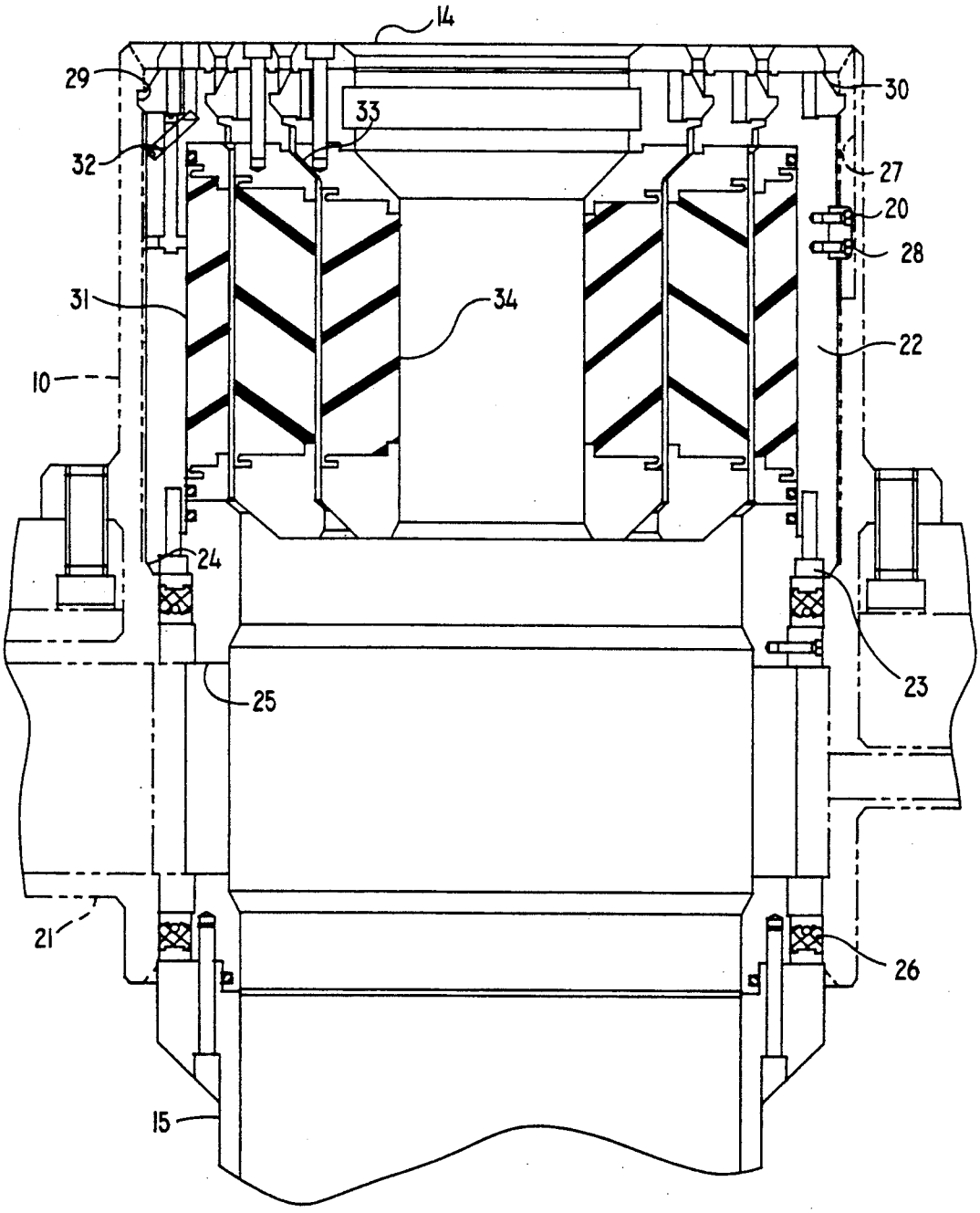
Figure 3:
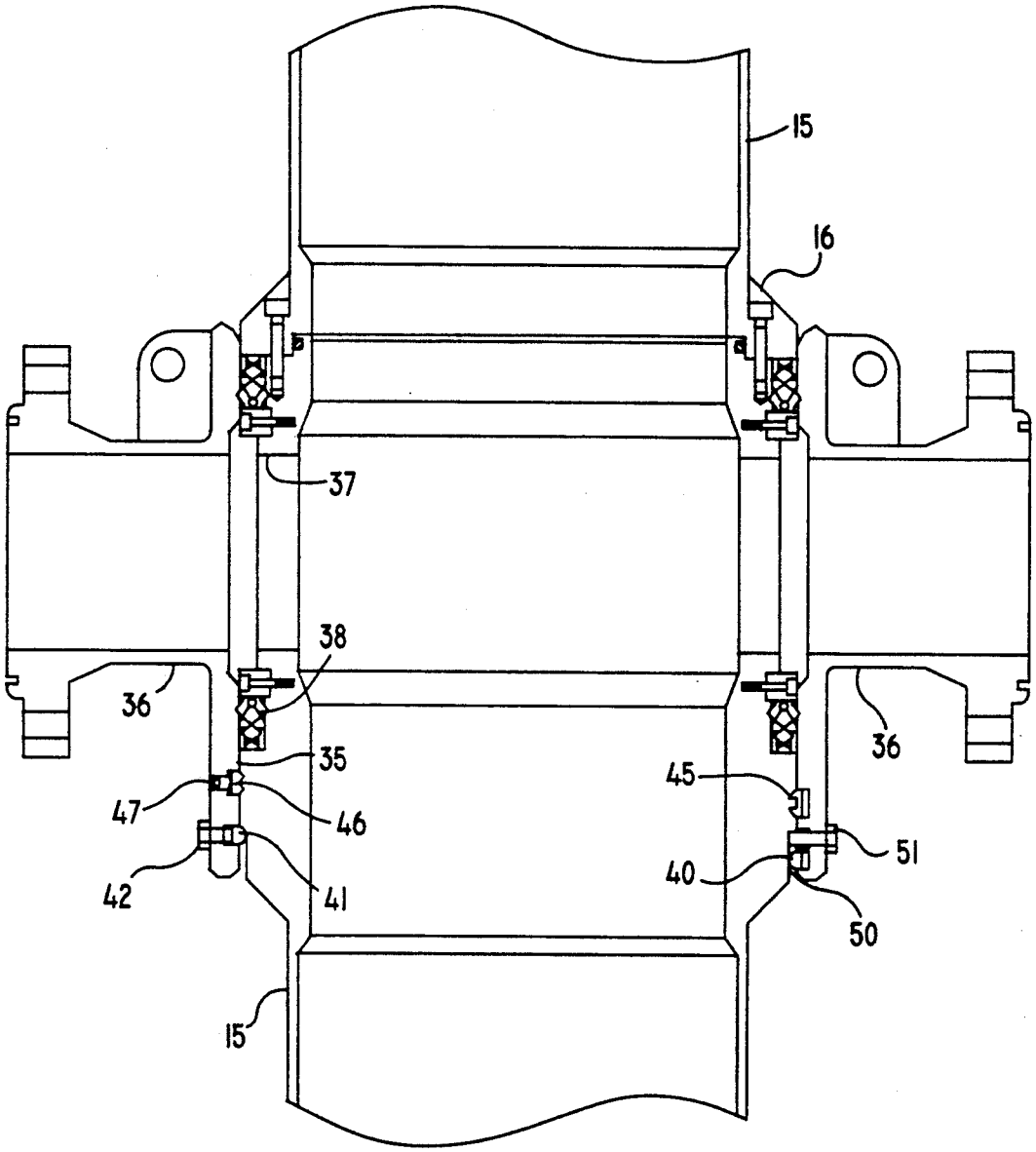

FIG. 2 is an enlarged, vertical sectional view of the primary housing with the diverter assembly installed therein; and FIG. 3 is an enlarged vertical sectional view of the secondary housing with the tubular member located therein.

With reference now to the details of the above described drawings, the overall diverter system shown in FIGS. 1A, 1B and 1C includes an upper primary housing 10 supported from beams installed beneath a rotary table 12 (shown in broken lines). As previously described, the rotary table is located on the offshore platform, which may be located on fixed legs or may be of the jack up type. The system 10 further includes a lower secondary housing 13 supported a substantial distance beneath the primary housing, a diverter assembly 14 installed within the housing 10, and a spool 15 suspended form the diverter assembly for extension through the secondary housing. Thus, the spool 15 includes a sub or tubular member 16 intermediate its upper and lower ends for fitting closely and landing within the secondary housing 13, and an overshot packer 17 on its lower end sealably engaged about the upper end of a conductor 18 which, as previously described, extends upwardly from the subsea wellhead (not shown).

As shown in each of FIGS. 1A and 2, the primary housing 10 has a bore 20 therethrough which is aligned axially with the rotary table 12, and side outlets 21 from the bore. The side outlets have flanges on their outer ends to permit flowlines to be connected thereto, or to permit blind flanges to be connected thereto for closing them.

As best shown in FIG. 2, the diverter assembly 14 includes a tubular body 22 adapted to fit closely within the bore 20 of the housing and having a shoulder 23 thereabout for landing upon a seat 24 within the bore above the side outlets 21. More particularly, the tubular body has ports 25 therethrough which, when the diverter assembly is landed in the primary housing, are aligned with the side outlets 21, and seal rings 26 carried thereabout the tubular body for sealably engaging bore 20 above and below the side outlets to confine flow from within the body into the outlets.

As shown in FIG. 2, a downwardly opening slot 27 is formed within the bore 20 of the primary housing to receive a lug 28 mounted on the outside of the tubular body 22 for orienting the body into a fixed rotational position within the primary housing in which its ports are aligned with the side outlets in the housing. As also shown in FIG. 2, the upper end of the bore 20 has a groove 29 thereabout adapted to receive outwardly urged latches 30 carried about the upper end of the tubular body for holding the tubular body in landed position within the primary housing.

As previously described, and as well known in the diverter system art, the diverter assembly 14 also includes means for sealing about a drill string (not shown) which extends downwardly through the rotary table and which has a bit at its lower end for drilling a wellbore beneath the subsea wellhead. As shown, this sealing means includes an outer inwardly inflatable rubber sleeve 31 which is inwardly contractible in response to the supply of fluid pressure to the outerside thereof through ports 32 in the body. In addition, annular packer elements 33 and 34 are lowered into and installed within the sleeve 31 and one another, as shown in FIG. 2, and releasably locked down by latches similar to those described in connection with the tubular body 22 of the diverter assembly.

The number and size of the removable packer elements depends, of course, upon the size of the drill string. In any event, the purpose of the packer elements is to permit the innermost element 34 to form a low pressure seal about the drill string upon inflation of the bladder 31. This then permits well fluid within the annulus between the drill string and the spool to be diverted through the ports and into the side outlets 25 and thus into flowlines connected thereto when drilling fluid is to be diverted at the upper level.

As previously described, the lower or secondary housing 13 like the primary housing has a bore 35 therethrough, which, with the secondary housing supported beneath the primary housing, as shown in FIG. 1B, is aligned with the bore through the primary housing. The secondary housing may be so supported in any suitable manner as by beams of the like extending downwardly from the platform. Alternatively, and will be described to follow, the secondary housing may be supported from the sub 16 of the spool 15 for lowering therewith. In any event, as in the case of the primary housing, the secondary housing has side outlets 36 from its bore 35, with flanges on the outer ends of the side outlets to permit flowlines to be connected thereto.

As previously described, the member 16 is connected intermediate the upper and lower ends of the spool 15 and is of a size for fitting closely and landing within the bore 35 of the secondary housing in a predetermined rotational position. With the sub so located, the packer 17 at the lower end of the spool fits over the conductor, as shown in FIG. 1. Thus, the length of the upper end of the spool depends on the desired level of the secondary housing, while the length of the lower end of the sub is so selected as to ensure that the overshot packer fits about and seals about the upper end of the conductor. These of course are determinations which are made by the operator depending on the well conditions.

As in the case of the tubular body of the diverter assembly, the sub 16 has ports 37 therethrough to connect the bore of the sub, and thus the spool, with the side outlets 36. More particularly, with the sub in a landed position within the secondary housing, the ports 37 are aligned with the side outlets 36, and as in the case of the tubular body of the diverter assembly, seal rings 38 are carried about the sub 16 for sealably engaging the bore 35 of the secondary housing to confine the flow through the ports into the side outlets 36.

As shown in FIG. 3, the sub has a shoulder 40 formed thereabout near its lower end, and a normally expanded split ring 41 is adapted to be moved inwardly from within a groove about the bore by means of bolts 42 mounted adjacent to the lower end of the secondary housing to form a seat on which the shoulder 40 may land to locate the sub vertically with respect to the secondary housing.

A locking groove 45 is also formed about the outer diameter of the sub above the landing shoulder 40 thereabout, and normally expanded split ring 46 is carried within a groove about the bore of the sub in position for latching into the groove 45 when the sub is located by means of the split ring 41. Thus, a screw 47 is mounted on the secondary housing for movement inwardly to force the ring into and hold it in locking position.

A downwardly opening slot 50 is formed above the landing shoulder for fitting over the inner end of a bolt 51 mounted on the secondary housing. Thus, the bolt may be moved inwardly to a position in which the slot 50 will move downwardly thereover for rotationally aligning the sub within the housing bore.

The normally expanded landing ring 41 and locking ring 46 and the normally retracted orienting pin 51 permit movement of the sub downwardly through the bore of the secondary housing during installation of the diverter system, whereby the operator is assured that the overshot packer is in place before he raises the sub upwardly to a position for landing on the ring 41. This is also useful in the event the secondary housing is initially supported just beneath the primary housing and mounted about the sub 16 as the spool is lowered through the primary housing to the desired level therebelow.

Thus, the improved system of this invention permits the operator, if desired, to close off outlets 21 of the primary housing, as by blind flanges, and connect flowlines to the side outlet 37 so that drilling fluid is diverted at the lower level of the secondary housing.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A diverter system for use in the drilling of a well from a platform above a subsea wellhead, comprising a primary housing adapted to be supported beneath the rotary table on the platform and having a bore therethrough and one or more side outlets from the bore, a secondary housing having a bore therethrough of essentially the same size as the bore through the primary housing and one or more side outlets from the bore and adapted to be supported beneath the primary housing with its bore aligned with the bore of the primary housing, a diverter assembly comprising an annular body adapted to be lowered into supported position within the bore of the primary housing and having one or more ports therethrough each aligned with a side outlet from the bore of the primary housing, when the assembly is so supported, and means thereon for sealing with the bore of the primary housing to confine flow within the body into said outlets, and a spool suspended from the diverter assembly body for lowering therewith through the bore of the primary housing, said spool including a tubular member intermediate its ends for fitting closely and landing within the bore of the secondary housing and having one or more ports therethrough each adapted to be aligned with a side outlet in the secondary housing, when so landed, and means thereon for sealing with the bore of the secondary housing to confine flow within the member into the side outlets, whereby well fluids in the annulus about a pipe extending through the spool and into a conductor extending upwardly from the wellhead may be diverted by said assembly into flowlines connected to one or more of the outlets of the housings.

2. For use in a diverter system wherein a spool is adapted to be suspended from a diverter assembly supportable within the bore of a housing supported beneath the rotary table on a platform above a subsea well, a second housing having a bore therethrough and side outlets from the bore and adapted to be supported beneath the first mentioned housing with its bore generally aligned with the bore of the first mentioned housing, a tubular member adapted to be connected as part of a spool suspended from the diverter assembly for lowering therewith into close fitting relation within the bore of the second housing, means for landing the member within the bore of the second housing including a downwardly facing shoulder about the member, an expandable and contractible split ring carried about the bore of the second housing for movement between a normally expanded position removed from the bore and a contracted position within the bore to provide a seat for the shoulder, and means for moving the ring inwardly to contracted position, means for locking the member in landed position within the bore including a locking groove about the member, an expandable and contractible split ring carried about the bore of the second housing for movement between a normally expanded position removed the bore and a contracted position within the bore for fitting within the groove, and means for moving the ring inwardly to contracted position, means for orienting the member into a predetermined rotational position within the bore of the second housing including a slot extending upwardly from the shoulder about the second member, a pin mounted in the second housing for movement between a retracted position removed from the bore and an extended position within the bore for fitting within slot as the member is lowered into landed position, and means for moving the pin inwardly to extended position, and said member having ports therethrough aligned with the side outlets when landed in the bore and means for sealing with respect to the bore above and below the ports, when the member is landed therein.

* * * * *